US007591229B2

(12) United States Patent
Jordan

(10) Patent No.: US 7,591,229 B2
(45) Date of Patent: Sep. 22, 2009

(54) FORESPAR FOR A SAILING VESSEL

(76) Inventor: Donald J. Jordan, 113 Evergreen La., Glastonbury, CT (US) 06033

( * ) Notice: Subject to any disclaimer, the term of this patent is extended or adjusted under 35 U.S.C. 154(b) by 71 days.

(21) Appl. No.: 11/511,778

(22) Filed: Aug. 29, 2006

(65) Prior Publication Data

US 2008/0053357 A1 Mar. 6, 2008

(51) Int. Cl.
*B63B 15/00* (2006.01)
*B63H 9/10* (2006.01)
*B63B 35/00* (2006.01)

(52) U.S. Cl. ..... 114/89; 114/90; 114/98; 114/99; 114/39.21

(58) Field of Classification Search ..... 114/39.21, 114/89–101
See application file for complete search history.

(56) References Cited

U.S. PATENT DOCUMENTS 3,112,725 A * 12/1963 Malrose ..... 114/39.28
3,194,202 A * 7/1965 Saunders ..... 114/39.29

* cited by examiner

*Primary Examiner*—Lars A Olson
*Assistant Examiner*—Daniel V Venne
(74) *Attorney, Agent, or Firm*—Alix, Yale & Ristas, LLP

(57) ABSTRACT

A spar for a sailing vessel comprises an elongated member which projects upwardly at an oblique angle from the centerline of the vessel deck and defines a longitudinal axis of rotation. The elongated member has a longitudinal slot for mounting the jib. The elongated member has a longitudinally extending aerodynamic surface defined by a quasi-elliptical shape with identical starboard tack and port tack leading edges symmetric about a plane through the rotational axis and the slot.

14 Claims, 4 Drawing Sheets

FORESPAR FOR A SAILING VESSEL

BACKGROUND OF THE INVENTION

This invention relates generally to mechanisms and structures employed in sailing yachts. More particularly, this invention relates to mechanisms and structures for attachment of a jib.

In conventional sailing vessels a forestay is employed for attachment of the jib. The forestay is typically attached at one end to the head or part way up the head of the mast and attached at an opposite end to a location proximate the bow of the vessel.

SUMMARY

Briefly stated, a spar, herein also called a forespar, for a sailing vessel comprises an elongated member having opposite first and second ends and defining a longitudinal axis of rotation. The elongated member has a longitudinal slot. The elongated member further has a longitudinally extending aerodynamic surface defined by a quasi-elliptical shape with identical starboard tack and port tack leading edges symmetric about a plane through the rotational axis and the slot.

A mechanism, which may be a spool and a line engaged with the spool for selectively producing a rotation of the spool, is employed to rotate the spar about the axis of rotation. The quasi-elliptical shape has a minor axis which intersects the plane. The elongated member may taper from the first end to the second end.

The elongated member may be manufactured from carbon fiber material. The elongated member has a surface portion opposite the slot which is substantially planar in one embodiment. In a second embodiment the elongated member has a second portion opposite the slot which is concave.

The spar projects upwardly at an oblique angle from a centerline of the deck. A jib is attached to the spar via one or more sliders disposed in the slot.

A wire or rod may be disposed along the axis of rotation for rotatably mounting the spar.

DETAILED DESCRIPTION OF THE PREFERRED EMBODIMENTS

With reference to the drawings wherein like numerals represent like parts throughout the several figures, a forespar for a sailing vessel is generally designated by the numeral 10. The forespar 10 comprises an elongated member which has a surface configuration adapted to improve the performance of sailing vessels by incorporating an airfoil technology to the structure which is provided for the attachment of the jib.

Figure 1:
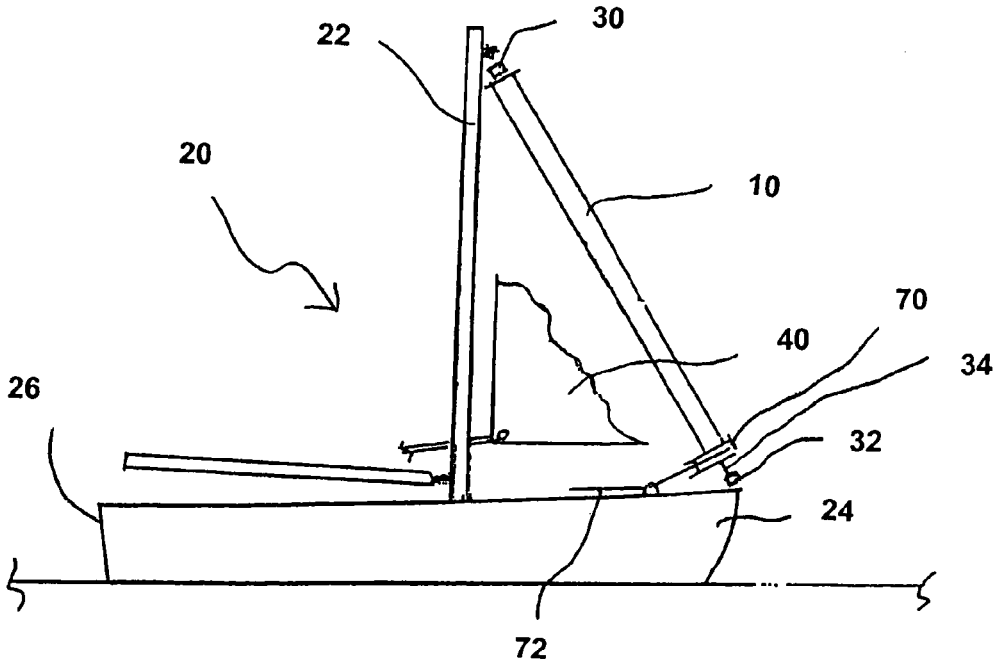
FIG. 1 is a representative illustration of a sailing vessel incorporating a forespar.
Figure 3:
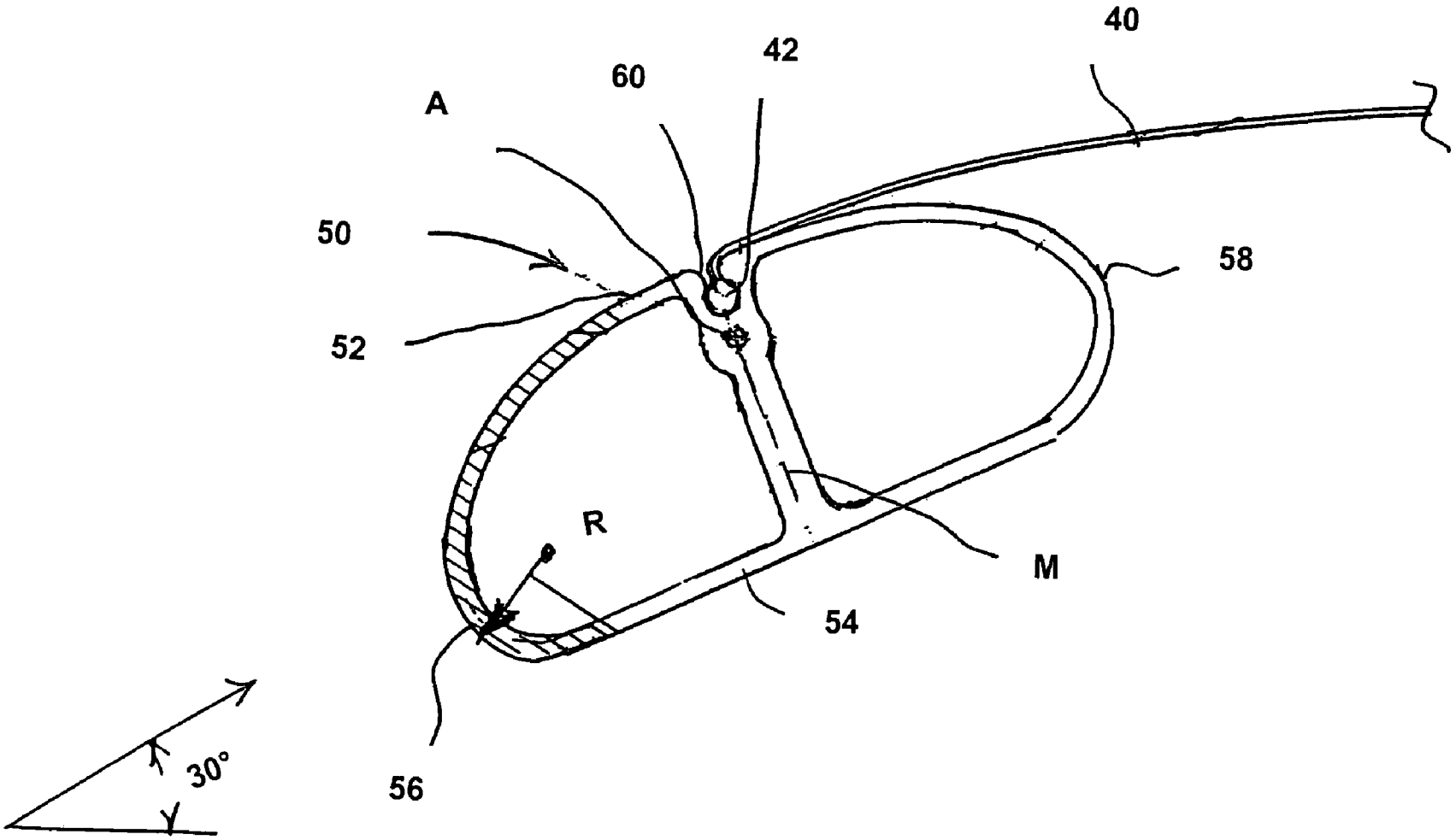
FIG. 3 is an enlarged sectional view, partly in diagrammatic form, of the forespar and further illustrating the attachment to a jib, partially illustrated.

As further illustrated in FIG. 1, a representative sailing vessel 20 has a mast 22 which projects vertically along the centerline C between the bow 24 and the stern 26 of the vessel. The forespar 10 is preferably attached to the mast 22 by a swivel connector 30 and to a location proximate the bow by a second swivel connector 32. Other connector hardware and mechanisms may also be suitable. The forespar is rotatable about a longitudinal axis which is oblique to the deck and mast. The forespar 10 can be designed to replace the conventional forestay to which the jib 40 is attached or can be mounted on the forestay. It should be appreciated that the forespar 10 need not be attached to the top of the mast 22, but may be attached at various locations along the vertical extant of the mast.

The forespar 10 is preferably manufactured from carbon fiber, fiberglass or other suitable material. The forespar structure is best appreciated by reference to various representative cross sections as illustrated in FIGS. 2 through 5. The longitudinally extruding surface shapes 50 may be described as quasi-elliptical in cross-section and symmetric about the minor axis M. Opposed first and second surfaces 52 and 54 continuously taper to form identical leading edges 56 and 58. The leading edges 56 and 58 of the forespar function in a manner analogous to the leading edge of an airfoil, such as NASA 4412 or similar airfoil configurations. The leading edge radius R (FIG. 2) is preferably one to two percent of the chord of an airfoil, although a larger radius may also be used. For a chord length of 15 feet, at the foot of the jib the radius accordingly would range from 2-4 inches.

The forespar is provided with a longitudinal groove or slot 60 which retains the conventional slides 42 (only one illustrated) employed to attach a jib. The slot 60 is located at one end of the minor axis M of the ellipse so that the forespar is symmetrical about this location and will have the same surface shape for the leading edges 56 and 58 on the port tack and on the starboard tack. The port tack and starboard tack positions are respectively designated PT and ST in FIG. 4.

The cross section of the forespar 10 may be tapered from the root to the tip to conform to the change in chord of the jib. 40. The forespar can retain the same shape as the size is tapered. Alternatively, the shape of the forespar may be changed as the forespar is tapered. However, the forespar must retain a cross sectional surface shape which is symmetrical about the minor axis M.

Figure 5A:
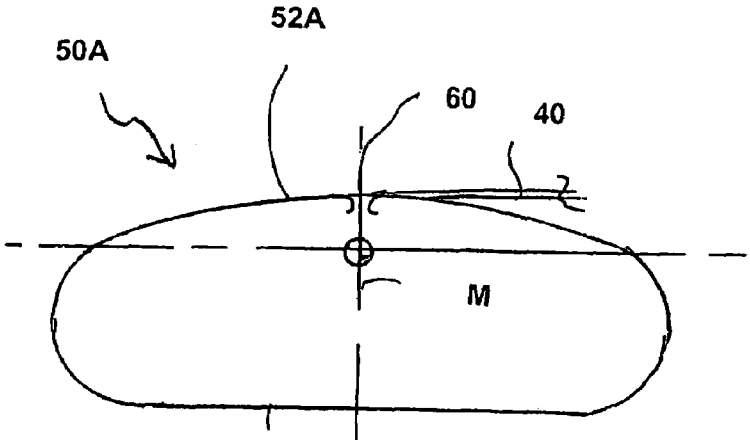
FIGS. 5A, 5B and 5C are schematic and diagrammatic views of the forespar in section illustrating various possible cross sectional shapes for the forespar and the attachment to a jib, partially illustrated.
Figure 5B:
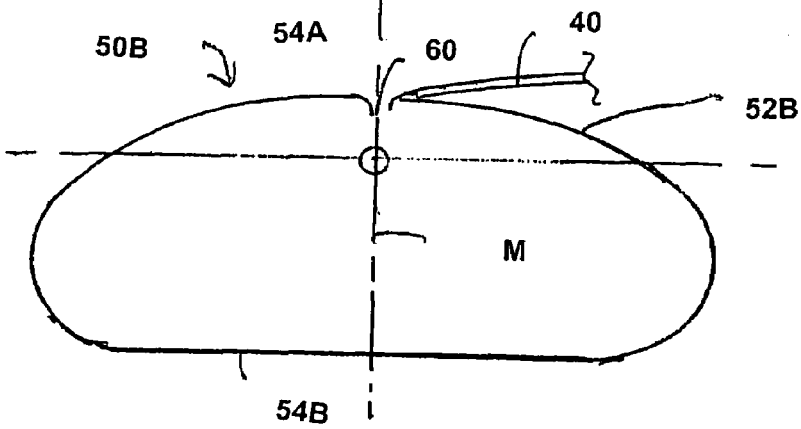
Figure 5C:
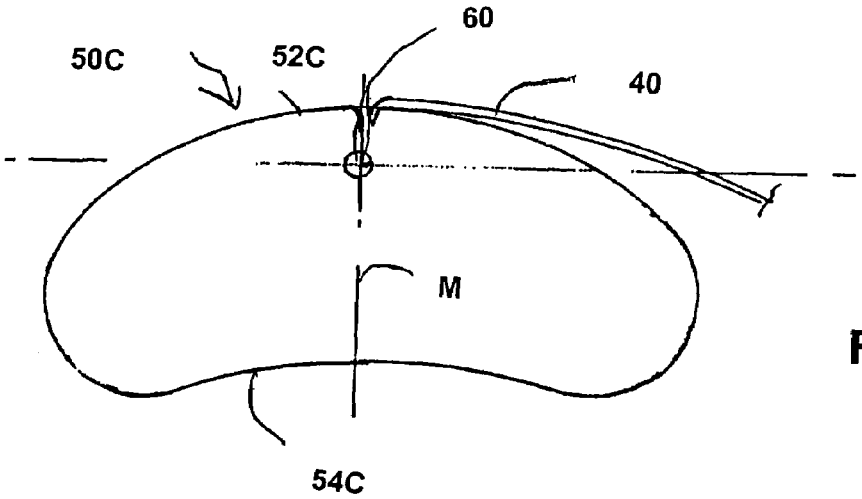

FIG. 5 shows several typical shapes 50A, 50B, 50C which might be chosen to be compatible with different jib designs or to compensate for differences in the inflow air angles at different heights above the deck. With reference to FIG. 5, and as viewed along the longitudinal extent surfaces 54A and 54B respectively opposite surfaces 52A and 52B are substantially planar surfaces 54C opposite surface 52C is concave. The forespar cannot be twisted nor have a twisted structure from root to tip, since this would not maintain the required symmetry relative to the minor axis M.

Figure 4:
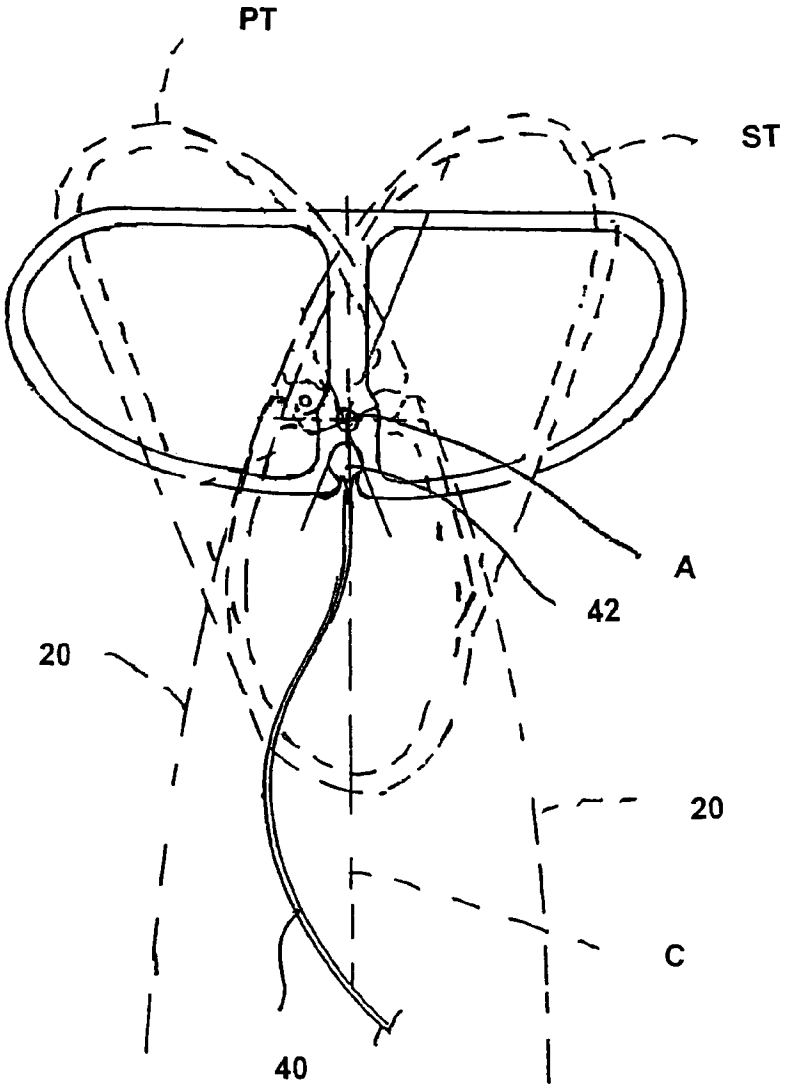
FIG. 4 is a schematic view, partly in broken lines, of the forespar in cross section relative to the vessel and the jib and further illustrating the positions of leading edge surfaces at different rotational positions of the forespar.

With reference to FIG. 4, it should be noted that the forespar presents the same shaped leading edge contour on the port tack PT and the starboard tack ST. This is accomplished by making the aft surface contour of the spar a mirror image of the forward surface, and then reversing the forespar end as the vessel tacks so that the opposite end is presented to the wind. The mainsail, in coming about, forms a mirror image relative to the centerline C of the vessel. Thus, the jib and mainsail will have the same performance on either tack.

The forespar 10 presents a smooth aerodynamic surface at the top or suction side of the jib, but also presents a blunt end at the low or pressure side of the jib. This blunt end does not cause a significant loss in performance as the low pressure side has a negative pressure gradient and the flow will not separate or cause a stall.

Figure 2:
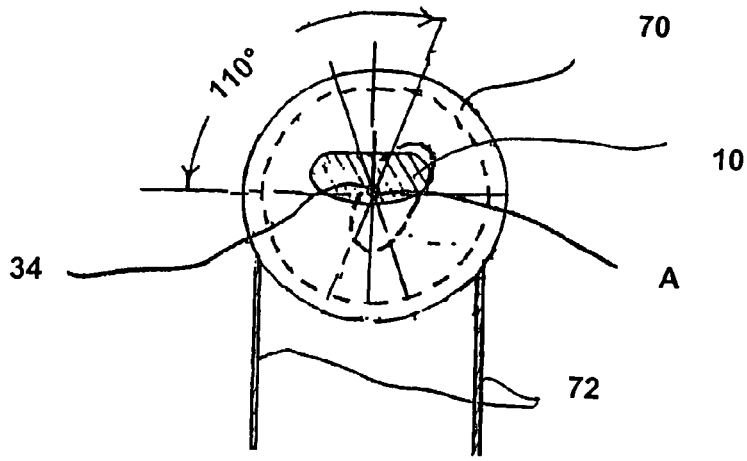
FIG. 2 is an enlarged fragmentary sectional view, partially in schematic, of the forespar and a mechanism for rotating the forespar.

The forespar 10 is designed to rotate about a fixed axis A as shown in FIG. 2. A rod or wire 34 may extend from the root to the tip, to provide an axle for rotation. Alternately, a suitable attachment fitting can also be provided at the ends of the basic mold of the forespar structure. Anti friction bearings (not illustrated) may be provided at the root tip of the forespar in a manner similar to the conventional roller furling rig. It is generally desirable to locate the axis of rotation A relatively close to the sail attaching slot 60 since this will reduce the torque transmitted to the forespar by the sail.

With reference to FIGS. 1 and 2, a spool 70 may be attached at the root of the forespar as illustrated. Control line 72 permits the vessel skipper to rotate the spool at any desired angle.

When the vessel tack comes about, the skipper must rotate the spar through an angle of approximately 220 degrees as illustrated in FIG. 4. This angle is adjustable to accommodate the wind and sea conditions. Such flexibility is useful to the racing skipper.

For smaller vessels the forespar 10 can be attached to a conventional rod or wire forestay. A simple drum lever (not illustrated) can be attached to base to accomplish the rotation. Since the forespar 10 is a rigid structure, it will not lose its shape as the jib luffs when coming about. The sail will luff later and fill sooner than with a conventional rig and the upwind performance will improve.

It is believed that the forespar 10, as illustrated, will provide an increase of 10% or more in the force or lift generated by the jib and also a comparable increase in the efficiency or lift to drag ratio of the sail plane. Consequently, an increase in the speed of the boat and in the upward sailing angle would result.

The invention claimed is:

1. A spar for a sailing vessel comprising:

an elongated member having opposed first and second ends and defining a longitudinal axis of rotation and a longitudinal opening traversing said axis from said first end to said second end;

said elongated member having a longitudinal slot; and said elongated member having a longitudinally extending aerodynamic surface defined by a cross-sectional shape which is substantially a convex section of an ellipse having a minor axis, said convex section being substantially an ellipse portion defined on a side bisected by the minor axis, and an opposing rear surface, said aerodynamic surface having identical starboard tack and port tack leading edges symmetric about a plane through said rotational axis and said slot wherein said plane is coincident with said minor axis and wherein said aerodynamic surface extends a greater distance than the maximum distance between said aerodynamic surface and said rear surface, and said slot being spaced from said longitudinal opening and communicating through said aerodynamic surface.

2. The spar of claim 1 and further comprising a mechanism mounted in fixed relationship to the spar for rotating the spar about the axis of rotation.

3. The spar and mechanism of claim 2 wherein said mechanism comprises a spool and a line engaged with said spool to selectively produce rotation thereof.

4. The spar of claim 1 wherein said elongated member has a cross section which tapers from said first end to said second end.

5. The spar of claim 1 wherein said elongated member is manufactured from material selected from the group consisting of carbon fiber material and fiberglass material.

6. The spar of claim 1 wherein said elongated member has a longitudinally extending surface portion opposite said slot which is substantially planar.

7. The spar of claim 1 said elongated member has a longitudinally extending surface portion opposite said slot which is concave.

8. The spar of claim 1 and further comprising an attachment slide disposed in said slot.

9. A sailing vessel having a deck and defining a centerline and comprising:

a spar projecting upwardly at an oblique angle from said deck and disposed on said centerline, said spar having longitudinally first and second ends and defining a longitudinal axis of rotation, and a longitudinal opening traversing said axis from said first end to said second end and a member received in said opening to permit rotation about said member, said spar having a longitudinally extending aerodynamic surface defined by a cross-sectional shape which is substantially a convex section of an ellipse having a minor axis, said convex section being substantially an ellipse portion defined on a side bisected by the minor axis, said aerodynamic surface having identical starboard tack and port tack leading edges symmetric about a plane through said rotational axis and a slot spaced from said opening and communicating through said aerodynamic surface, said plane being coincident with said minor axis; and a jib attached to said spar by a slide disposed in said slot.

10. The sailing vessel of claim 9, further comprising a mechanism mounted in fixed relationship to the spar for rotating the spar about the axis of rotation.

11. The sailing vessel of claim 10 wherein the spar is rotatable to subtend an angle of approximately 220°.

12. The sailing vessel of claim 10 wherein said mechanism comprises a spool and a line engaged with said spool.

13. The sailing vessel of claim 9 further comprising a mast and defining a bow, said spar being mounted at the first end to said bow and at the second end to said mast.

14. The sailing vessel of claim 13 further comprising an axle disposed on said rotational axis of said spar.

* * * * *